US005148986A

United States Patent [19]

Rusch

[11] Patent Number: 5,148,986

[45] Date of Patent: Sep. 22, 1992

[54] HIGH PRESSURE THERMAL SPRAY GUN

[75] Inventor: William P. Rusch, Lake Ronkonkoma, N.Y.

[73] Assignee: The Perkin-Elmer Corporation, Norwalk, Conn.

[21] Appl. No.: 732,978

[22] Filed: Jul. 19, 1991

[51] Int. Cl.[5] ..... B05B 1/24

[52] U.S. Cl. ..... 239/85; 239/79; 219/76.16; 219/121.47; 219/121.51

[58] Field of Search ..... 239/79, 80, 81, 82, 239/83, 84, 85, 424, 427.5, 432; 219/121.47, 76.14, 76.16, 121.51, 121.47

[56] References Cited

U.S. PATENT DOCUMENTS

| | | | |
|---|---|---|---|
| 2,233,304 | 2/1941 | Bleakley | 239/80 |
| 2,643,955 | 6/1953 | Powers et al. | 239/85 |
| 2,920,001 | 1/1960 | Smith et al. . | |
| 4,004,735 | 1/1977 | Zverev et al. | 239/79 |
| 4,363,443 | 12/1982 | Huehne . | |
| 4,416,421 | 11/1983 | Browning . | |
| 4,865,252 | 9/1989 | Rotolico et al. . | |
| 4,928,879 | 5/1990 | Rotolico | 219/121.47 |
| 4,964,568 | 10/1990 | Rotolico et al. | 219/121.47 |
| 5,014,916 | 5/1991 | Trapani et al. | 239/85 |
| 5,019,686 | 5/1991 | Marantz | 219/76.14 |
| 5,047,265 | 9/1991 | Simm et al. | 239/80 |

FOREIGN PATENT DOCUMENTS

| | | | |
|---|---|---|---|
| 0361709 | 4/1990 | European Pat. Off. . | |
| 3623312 | 1/1988 | Fed. Rep. of Germany | 239/79 |

*Primary Examiner*—Andres Kashnikow
*Assistant Examiner*—Christopher G. Trainor
*Attorney, Agent, or Firm*—H. S. Ingham; E. T. Grimes

[57] ABSTRACT

A high velocity thermal spray gun includes a nozzle member injecting an annular flow of combustible mixture at high pressure into a constricted gas cap. An outer flow of air is injected adjacent to the gas cap wall. Powder is fed axially from the nozzle member into the combustion chamber. An annular inner flow of air is injected coaxially outwardly of the powder. The nozzle face has a shallow annular slot therein between the outer and inner gas injections. Combustion gas and oxygen flow through separate annular gas channels to mutually impinge at the inlet end of the slot for effectual mixing, so that combusting of the combustible mixture is rooted in the annular slot.

9 Claims, 3 Drawing Sheets

HIGH PRESSURE THERMAL SPRAY GUN

This invention relates to thermal spraying and particularly to a gun for combustion thermal spraying powder at very high velocity.

BACKGROUND OF THE INVENTION

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A thermal spray gun is used for the purpose of both heating and propelling the particles. In one type of thermal spray gun, the heat fusible material is supplied to the gun in powder form. Such powders are typically comprised of small particles, e.g., between 100 mesh U.S. Standard screen size (149 microns) and about 2 microns. The carrier gas, which entrains and transports the powder, can be one of the combustion gases or an inert gas such as nitrogen, or it can be simply compressed air.

Especially high quality coatings of thermal spray materials may be produced by spraying at very high velocity. One type of high velocity powder spray gun is disclosed in U.S. Pat. No. 4,416,421 (Browning). This type of gun has an internal combustion chamber with a high pressure combustion effluent directed through an annular opening into the constricted throat of a long nozzle. Powder is fed axially within the annular opening into the nozzle chamber to be heated and propelled by the combustion effluent.

Another high velocity thermal spray gun is disclosed in U.S. Pat. No. 4,865,252 (Rotolico et al). The gun has a nozzle member and a gas cap with a combustion chamber extending therefrom. A combustible mixture is injected coaxially into the combustion chamber at a pressure therein of at least two bar above atmospheric pressure. An annular outer flow of pressurized non-combustible gas is injected adjacent to the cylindrical wall of the gas cap. Powder in a carrier gas is fed axially from the nozzle into the combustion chamber, and an annular inner flow of pressurized gas is injected into the combustion chamber coaxially between the combustible mixture and the powder-carrier gas.

Various configurations have been used for mixing the combustion and oxygen gases in thermal spray guns. A siphon plug used in the gun of the above-mentioned U.S. Pat. No. 4,865,252 is typical. However, unless proper lighting and running procedures are followed, a siphon plug sometimes has a propensity to allow backfire at very high pressures utilized for high velocity, particularly with hydrogen fuel.

Other high velocity thermal spray guns are disclosed in U.S. Pat. No. 2,920,001 (Smith et al) and European Patent Application No. 0 361 709 A1. The former shows several early concepts of such guns. The latter shows an elongated gas cap extending from a nozzle that injects combustion gas and oxygen separately for mixing and combustion in the gas cap. Mixing within the nozzle of a low velocity gun is taught in U.S. Pat. No. 4,363,443 (Heuhne).

SUMMARY OF THE INVENTION

Objects of the present invention are to provide an improved gun for combustion powder thermal spraying at high velocity, and to provide a gun for thermal spraying at high velocity with reduced tendency for nozzle buildup. Further objects are to provide an improved thermal spray gun with a constricted gas cap, to provide for operation at increased pressure, and to provide a higher pressure gun without propensity to backfire. Another object is to provide a thermal spray gun with a novel gas mixing arrangement.

The foregoing and other objects are achieved with a thermal spray gun for spraying at high velocity that includes a nozzle member with a nozzle face and an axis, and a gas cap with an inwardly facing cylindrical wall defining a combustion chamber extending from the nozzle face to an open end. The gun further includes combustion means for injecting an annular flow of a combustible mixture of a combustion gas and oxygen from the nozzle member coaxially into the combustion chamber at a pressure therein of at least three bar above atmospheric pressure, outer gas means for injecting an annular outer flow of pressurized non-combustible gas adjacent to the cylindrical wall radially outward of the annular flow of the combustible mixture, feeding means for feeding heat fusible powder in a carrier gas coaxially from the nozzle member into the combustion chamber proximate the axis, and inner gas means for injecting an annular inner flow of pressurized gas from the nozzle member into the combustion chamber coaxially between the combustible mixture and the powder-carrier gas. With combusting of the combustible mixture, a high velocity spray stream containing the heat fusible powder is propelled through the open end.

According to the present invention the combustion means comprises the nozzle face having a shallow annular slot therein between the outer gas means and the inner gas means, and gas mixing means disposed in the nozzle member adjoining the annular slot and communicating therewith. The mixing means is receptive of separate flows of the combustion gas and the oxygen for mixing same and effecting the combustible mixture into the annular slot. Combusting of the combustible mixture is thereby rooted in the annular slot.

In a preferable aspect, the mixing means comprises the nozzle member having separate annular gas channels therein receptive respectively of the combustion gas and the oxygen. The gas channels meet at an inlet end of the annular slot so that the combustion gas and the oxygen mutually impinge for effectual mixing into the annular slot.

DETAILED DESCRIPTION OF THE INVENTION

Figure 1:
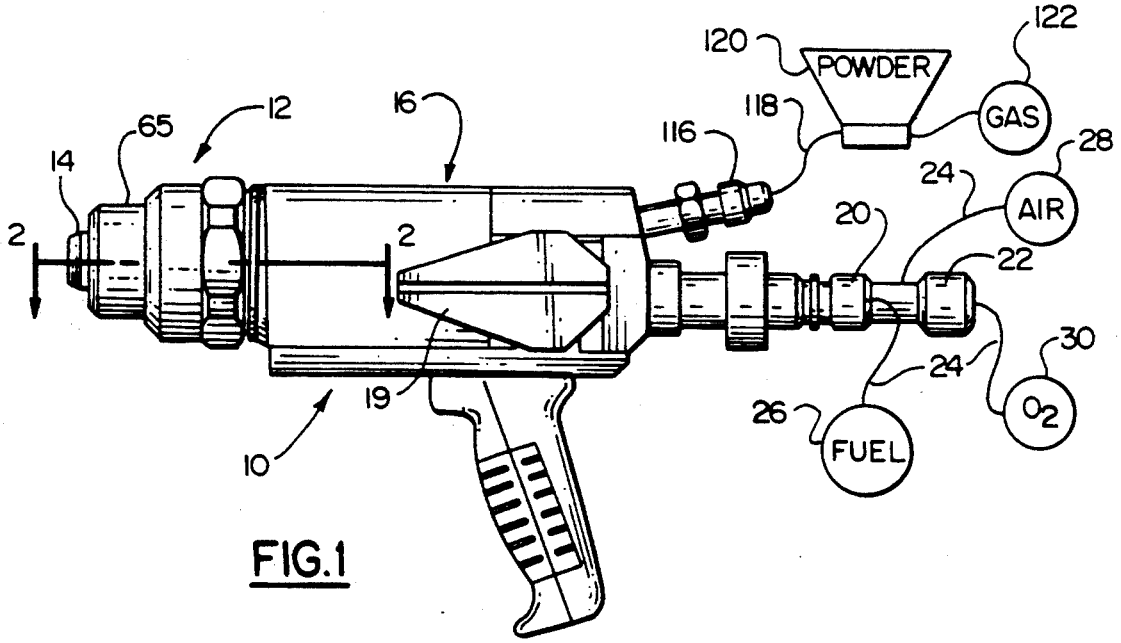
FIG. 1 is an elevation of a thermal spray gun of the present invention.

A thermal spray apparatus of the invention shown in FIG. 1 has basic components generally of the type described in U.S. Pat. No. 4,865,252. Thus a thermal spray gun 10 has a gas head 12 with a gas cap 14 mounted thereon, and a valve portion 16 for supplying fuel, oxygen and air to the gas head, and a handle 18. The valve portion has a valve lever 19, a hose connection 20 for fuel gas, a hose connection 22 for oxygen and a hose connection (hidden) for air. The three connections are connected respectively by hoses 24 to a fuel source 26, an oxygen source 28 and an air source 30. Inside the gun (FIG. 2), a nozzle member 32, an intermediate member 34 and a rear member 36 are held together in a gas body 38 with a nozzle nut 40. The burner nozzle 32 extends into the gas cap 14 which has a combustion chamber 42.

Figure 3:
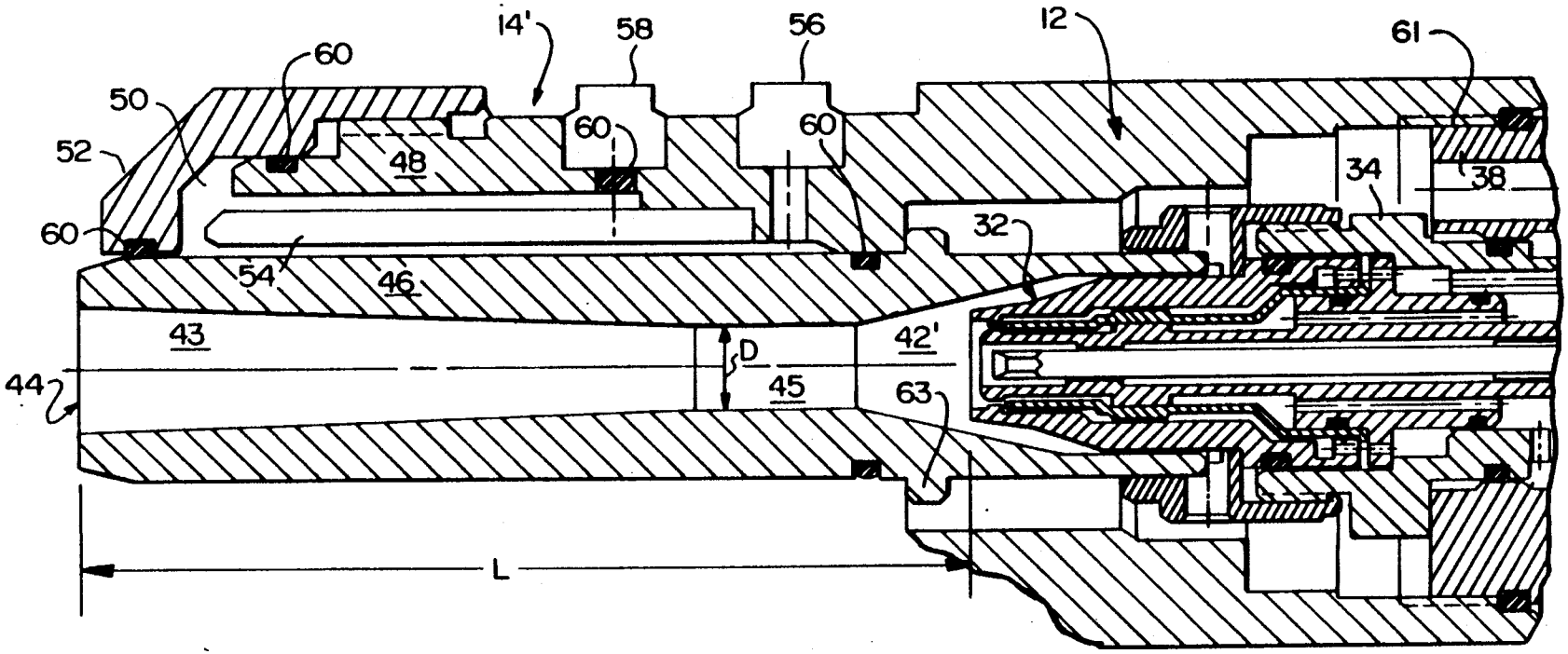
FIG. 3 is a partial section of a thermal spray gun of the invention with an elongated gas cap.

According to another aspect of the invention a gas cap 14' is elongated, as shown in FIG. 3. This gas cap has a combustion chamber 42' and an acceleration chamber 43 extending from the nozzle 32 to an open end 44, with a forwardly converging portion proximate the nozzle and extending therefrom to a constriction 45. The ratio of chamber length L to minimum chamber diameter D (in the constriction) is substantially greater than one, the ratio preferably being between about 5 and 25. The elongated gas cap is formed of a tubular inner member 46 and a tubular outer member 48 with water channeling 50 therebetween for cooling, with a forward retainer 52 and a cylindrical baffle 54 for the channeling. A water inlet 56 and outlet 58 support flow-through of the water, and appropriate O-rings 60 seal the channeling. The outer member is attached to the body 38 with threading 61 and retains the inner member 46 by a flange 63 thereon. The elongation of the gas cap chamber 43 provides for an extended heating and accelerating zone for a thermal spray powder such as cobalt bonded tungsten carbide.

Figure 2:
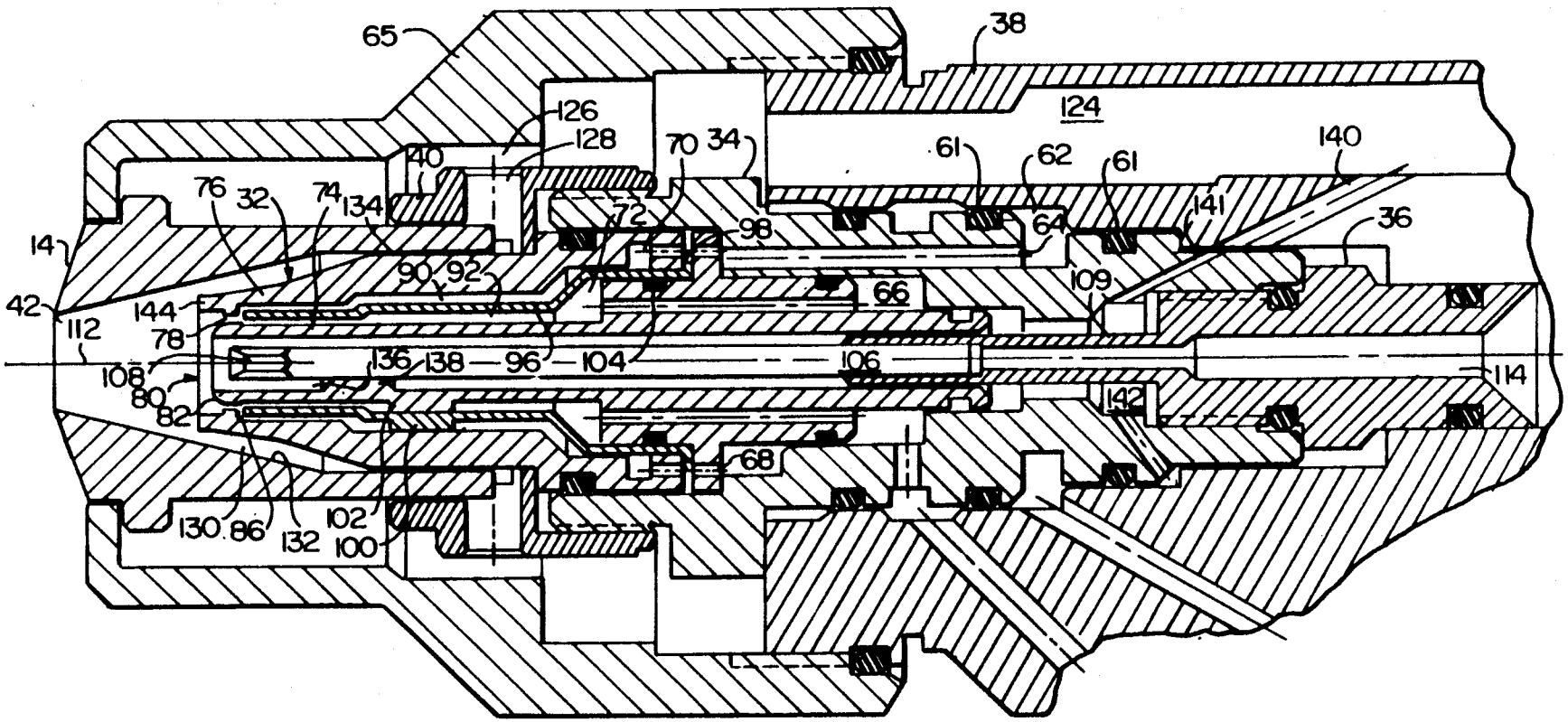
FIG. 2 is a section taken a 2—2 of FIG. 1.

Details of the gas head 12 are shown more extensively in FIG. 2 for a short gas cap 14, although it should be understood that the same configurations are used with the elongated gas cap of FIG. 3. In this case the gas cap 14 is held on the body 38 with a threaded cap nut 65.

The present gun does not contain the siphon plug taught in the above-mentioned U.S. Pat. No. 4,865,252. In place thereof is the intermediate member 34 fitted in a corresponding bore in the gas body 38 with a plurality of O-rings 60 to maintain a gas-tight seal. The member 34 has therein a first annular groove 62 associated with at least one and preferably 8 arcuately spaced longitudinal passages 64 (one shown) directed forwardly therefrom. (As used herein and in the claims, "inner" denotes toward the axis and "outer" denotes away from the axis. Also "forward" or "forwardly" denotes toward the open end of the gun; "rear", "rearward" or "rearwardly" denotes the opposite.)

The member 34 also has a second annular groove 66 forward of the first groove 62. At least one and preferably 12 further arcuately spaced longitudinal passages 68 (two shown) are directed forwardly from the second groove, spaced outwardly from the first passages 64. The two sets of passages 64,68 lead to respective annular spaces 70,72 in the rear section of the nozzle member 32.

Figure 4:
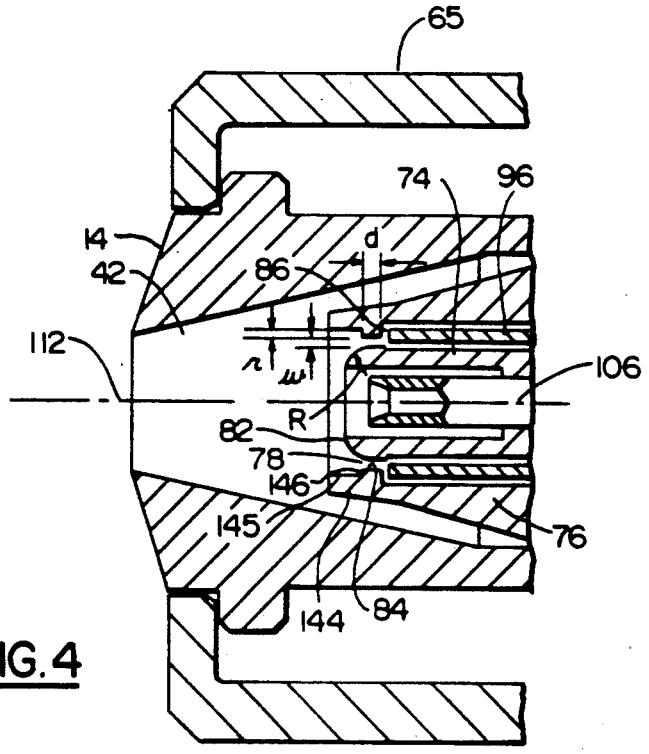
FIG. 4 is a detail of a portion of FIG. 2.

The nozzle member 32 is constructed conveniently of a tubular inner portion 74 and a tubular outer portion 76 which together define a combustion means including an annular slot 78 in the nozzle face 80 for injecting an annular flow of a combustion mixture of the combustion gas and the oxygen into the combustion chamber. The slot has a radially inward side bounded by an inner wall 82 formed by the inner portion, and by an outer wall 84 formed by the outer portion. The slot should be relatively shallow, generally with a ratio of depth d to width w (FIG. 4) between about one and four.

The nozzle member 32 has separate annular gas channels 90,92 therein receptive respectively of oxygen and the combustion gas from respective annular spaces 70,72. The gas channels meet at an annular cavity 86 constituting a mixing zone. The gas channels alternatively may be a plurality of arcuately space passages; advantageously, however, the gas channels are respective annular channels separated by a cylindrical baffle 96 disposed in the space between the inner and outer portions of the nozzle member. The baffle may be held in place by a flange 98 at the rear thereof between the inner and outer portions 74,76 of the nozzle, with two sets of spacers 100,102 on the baffle and the inner member. An O-ring 104 near the flange prevents mixing of the gases prematurely. To assure thorough mixing in the mixing zone, the oxygen and combustion gases flowing through the respective gas channels 90,92 should be mutually impinged on each other in the annular cavity 86. The ignited combustible mixture is rooted in the annular slot 78.

A tube 106 with a central passage 108 for the powder extends from a tubular protrusion 109 of the rear member 36 into inner member 74 of the nozzle. Alternatively the powder may be injected through a small-diameter ring of orifices (not shown) proximate the axis 112 of the gun. A diagonal passage (not shown) extends rearwardly from a passage 114 in the rear member to a powder connection 116 (FIG. 1). A carrier hose 118 and, therefore, central passage 108, is receptive of powder from a powder feeder 120, the powder being entrained in a carrier gas from a pressurized gas source 122 such as compressed air. The powder feeder is of the conventional or desired type but must be capable of delivering the carrier gas at high enough pressure to provide powder into the chamber 42 in gun 10.

Compressed air or other non-combustible gas is passed from source 28 through its connection 116 and a passage 124 (FIG. 2) to an annular space 126 in the interior cap nut 65. Lateral openings 128 in nozzle nut 40 communicate space 126 with combustion chamber 42 in gas cap 14. The air flows as an outer sheath from space 126 through these lateral openings, thence through an annular channel 130 between the outer surface of outer nozzle portion 76, and an inwardly facing cylindrical wall 132 that also defines combustion chamber 42 into which slot 130 exits. The flow continues through chamber 42 as an annular outer flow mixing with the inner flows, and out of the open end 44 in gas cap 14. Chamber 42 is bounded at its opposite, rearward end by face 80 of nozzle 32.

Preferably combustion chamber 42 converges forwardly from the nozzle at an angle with the axis, most preferably between about 5° to 15°, e.g. 12°. Channel 130 also converges forwardly from the nozzle at an angle with the axis, most preferably between about 12° and 16°, e.g. 14.5°. Channel 130 further should have sufficient length for the annular air flow to develop. This configuration provides a converging air flow with respect to the chamber to minimize powder buildup on the chamber wall.

The air flow rate should be controlled upstream of channel 130 such as in a rearward narrow orifice 134 or with a separate flow regulator. For example orifice length is 8 mm, slot width is 0.38 mm on a 15 mm circle, and air pressure to the gun is 90 psi to produce a total air flow of 800 scfh with a pressure (above atmospheric) of 80 psi (5.4 bar) in chamber 42.

The inner portion 74 of nozzle member 32 has therein an annular duct 136 formed with the outside of tube 106 which is held in place with four protrusions 138 (one shown). This duct provides for an annular inner sheath flow of gas, preferably air, about the central powder feed issuing from bore 108 in the nozzle. The sheath air is conveniently tapped from passage 124, via a pair of ducts 140,141 to an annular groove 142 around the forward portion of rear member 36. The inner sheath air flow should be between 1% and 10%, preferably about 2% and 5% of the outer sheath flow rate, for example about 3%. The inner sheath may alternatively be regulated independently of the outer sheath air, for better control.

According to further aspects (FIG. 4) inner wall 82 bounding annular slot 78 preferably extends forwardly from the annular slot with a curvature toward the axis 112. The radius of curvature R should be between about 1 and 5 times slot width w. Outer member 76 has a forwardly extending protrusion 144 beyond the annular slot. The outer wall has its rearward section 84 bounding the annular slot, a forward section 145 extending forwardly beyond the annular slot, and a radial shoulder 146 connecting the rearward section and the forward section. The shoulder should have a radial dimension r less than the slot width w.

A supply of each of the gases to the cylinder combustion chamber is provided at a sufficiently high pressure, e.g. at least 60 psi above atmospheric, and is ignited conventionally such as with a spark device, such that the mixture of combusted gases and air will issue from the open end as a high velocity, supersonic flow entraining the powder. The heat of the combustion will at least heat soften the powder material such as to deposit a coating onto a substrate.

The combustion gas, for example, may be hydrogen, propylene gas, or methylacetylene-propadiene gas. These gases allow a relatively high velocity spray stream and excellent coatings to be achieved without backfire. For example with hydrogen pressure of about 9.8 kg/cm$^2$ gauge (140 psig) (above atmospheric pressure), oxygen at 12 kg/cm$^2$ (170 psig) and air at 6.3 kg/cm$^2$ (90 psig) are supplied to the gun. Coating quality is excellent. Especially dense and tenacious coatings of metals and metal bonded carbides are effected. For example −37 micron powders of 12% and 17% cobalt bonded tungsten carbide (Metco 2003, 2004, and 2005 powders sold by The Perkin-Elmer Corporation, Westbury, N.Y.) and 25% nickel-chromium/chromium-carbide (Metco 81VF powder) have a high quality (in terms of density, toughness, low solution of carbide-matrix and wear resistance).

Coatings produced according to the present invention are particularly useful on gas turbine engine parts where high quality coatings, such as cobalt bonded tungsten carbide and nickel-chromium bonded chromium carbide, are required. Other combinations such as iron bonded titanium carbide, as well as metals including alloys of iron, nickel, cobalt, chromium and copper are similarly excellent for producing a coating according to the present invention. Coating quality combining low oxide content, high bond strength, low density and high tenaciousness surpass state-of-the-art plasma coatings and are competitive in quality with detonation gun coatings at much lower cost. These results are effected with minimized tendency for buildup. Further advantages should include easy lighting with the same gases as used in operation, and without backfire.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

I claim:

1. A thermal spray gun for spraying at high velocity, comprising a nozzle member with a nozzle face and an axis, a gas cap with an inwardly facing cylindrical wall defining a combustion chamber extending from the nozzle face to an open end, combustion means for injecting an annular flow of a combustible mixture of a combustion gas and oxygen from the nozzle member coaxially into the combustion chamber at a pressure therein of at least three bar above atmospheric pressure, outer gas means for injecting an annular outer flow of pressurized non-combustible gas adjacent to the cylindrical wall radially outward of the annular flow of the combustible mixture, feeding means for feeding heat fusible powder in a carrier gas coaxially from the nozzle member into the combustion chamber proximate the axis, and inner gas means for injecting an annular inner flow of pressurized gas from the nozzle member into the combustion chamber coaxially between the combustible mixture and the powder-carrier gas, such that, with combusting of the combustible mixture, a high velocity spray stream containing the heat fusible powder is propelled through the open end;

wherein the combustion means comprises the nozzle face having a shallow annular slot therein between the outer gas means and the inner gas means, and gas mixing means disposed in the nozzle member, the mixing means adjoining the annular slot and communicating therewith, and the mixing means being receptive of separate flows of the combustion gas and the oxygen for mixing the flows and effecting the combustible mixture into the annular slot, whereby the combusting of the combustible mixture is rooted in the annular slot.

2. The thermal spray gun of claim 1 wherein the mixing means comprises the nozzle member having separate annular gas channels therein receptive respectively of the combustion gas and the oxygen, the gas channels meeting at an inlet end of the annular slot so that the combustion gas and the oxygen mutually impinge for effectual mixing into the annular slot.

3. The thermal spray gun of claim 1 wherein the annular slot has a ratio of depth to width between about one and four.

4. The thermal spray gun of claim 1 wherein the nozzle member comprises an inner member defining an inner wall inwardly bounding the annular slot and extending forwardly from the annular slot with a curvature toward the axis.

5. The thermal spray gun of claim 4 wherein the nozzle member comprises an outer member with an outer wall outwardly bounding the annular slot and extending forwardly beyond the annular slot.

6. The thermal spray gun of claim 5 wherein the annular slot has a slot width, and the outer wall has a rearward section bounding the annular slot, a forward section extending forwardly beyond the annular slot, and a radial shoulder connecting the rearward section and the forward section, the shoulder having a radial dimension less than the slot width.

7. The thermal spray gun of claim 1 wherein the combustion chamber has a forwardly converging portion thereof proximate the nozzle face.

8. The thermal spray gun of claim 7 wherein the chamber is elongated with a ratio of length to minimum diameter substantially greater than one.

9. The thermal spray gun of claim 8 wherein the ratio of length to minimum diameter is between about 5 and 25.

* * * * *